United States Patent [19]

Nielsen, Jr.

[11] 4,158,953

[45] Jun. 26, 1979

[54] FRONT ENTRY ELECTRIC METER LOCK

[76] Inventor: Anker J. Nielsen, Jr., 410 Bailey Rd., Holden, Mass. 01520

[21] Appl. No.: 889,428

[22] Filed: Mar. 23, 1978

[51] Int. Cl.[2] ..... B65D 55/14

[52] U.S. Cl. ..... 70/164; 70/19; 70/232; 70/DIG. 57

[58] Field of Search ..... 70/19, 34, 159, 163, 70/164, 229, 232, DIG. 57; 24/279, 280; 292/256, 256.67

[56] References Cited

U.S. PATENT DOCUMENTS

| | | | |
|---|---|---|---|
| 3,861,180 | 1/1975 | Heckrotte | 70/164 |
| 3,867,822 | 2/1975 | Morse | 70/164 |
| 4,008,585 | 2/1977 | Lundberg | 70/164 |
| 4,080,811 | 3/1978 | Nielsen | 70/164 |

*Primary Examiner*—Robert L. Wolfe

*Attorney, Agent, or Firm*—Robert K. Randall

[57] ABSTRACT

This device provides greater ease in locking and unlocking the means provided in my prior U.S. Pat. No. 3,867,822 for securing electric meters from tampering. The key enters from the front of the meter box instead of from the side.

5 Claims, 7 Drawing Figures

FRONT ENTRY ELECTRIC METER LOCK

The present is an improvement on the device of my prior U.S. Pat. No. 3,867,822, granted Feb. 25, 1975, which prevents unauthorized opening of the electric meter by providing a yoke enclosing the lugs on the ends of the usual U-section split ring retaining band which keeps the meter closed, and putting a bolt type lock through four aligned holes in the lugs and in the yoke. The clamping screw through the lugs cannot be reached until the yoke is removed, and the locking ring prevents access to the meter works. Having proved successful in reducing theft of current, it has been widely used by public service electric light companies.

If office buildings, apartment houses, and other multiple service installations the mounting of the meters in compact array on basement walls is normally unavoidable. Thus scant space is left between adjacent meters for manipulation of the key for the bolt lock, disposed in such prior structure with its axis parallel to the plane of the locking band or ring. The strong springs essentially present in both the lock and its key require a firm grip and about 8 inches scope of transverse movement of the operator's hand in working the lever of the key and withdrawing the bolt lock therewith.

In accordance with the present invention, the structure of the terminal portions of the locking ring as well as the yoke are changed to receive the bolt lock with its axis perpendicular to the plane of the ring, so that no adjacent meter or other obstruction incidental thereto will impede the manipulation required in locking and unlocking the bolt lock.

An illustrative embodiment of the invention is shown in the accompanying drawings, in which FIG. 1 shows a typical electric meter in a bowl type housing mounted on a wall panel, and secured by a locking ring held by a yoke and bolt lock of the improved front access type.

Figure 1:
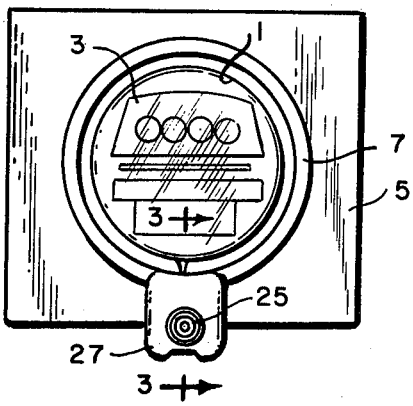
Figure 2:
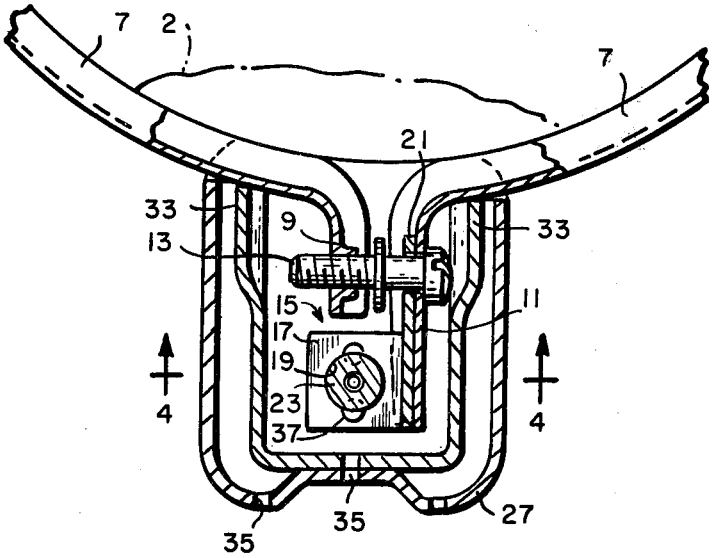
FIG. 2 is a transverse vertical section on the median plane of the locking ring of FIG. 1.

The electric meter of FIG. 1 is of conventional type comprising a glass bowl or cover, enclosing the meter works and dials 3 in the usual bowl-shaped metal case or base or other receptable 2 mounted on a panel or wall 5. The two bowls are clamped together rim to rim by the usual type of steel split ring 7 of U-section encircling and embracing the matching and co-engaging flanges on the bowl 1 and the metal case. This locking ring 7 is made of fairly thick steel stock, anti-corrosion plated, and hardened for stiffness, with integral lugs 9, 11 formed by bending the ends of the split circle outward to stand out nearly radially and parallel to each other when the ring is in place on the meter with the clamping screw 13 in place, all as heretofore.

Figure 6:
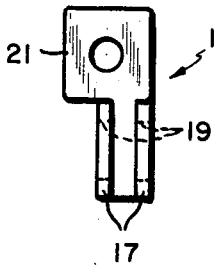
FIG. 5, 6 and 7 are respectively front, side, and bottom views of the element on the locking ring engaged by the bolt lock.
Figure 5:
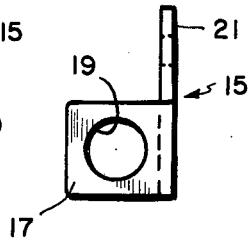
Figure 7:
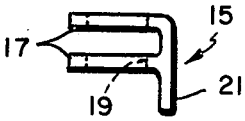

In accordance with the present invention, the lugs 9 and 11 are made of unequal extent radially of the ring 7. The longer lug 11 is provided with a member 15, FIGS. 5, 6 and 7, having two parallel spaced wings 17 having two aligned coaxial circular holes forming rings 19. These wings are conveniently formed by folding them out from an integral shank 21. This shank is welded to lug 11 between the marginal flanges thereof, with the wings 17 standing out in planes substantially parallel to that of the locking ring 7 in spaced relation to each other and radially outward beyond the end of lug 9 and clamping screw 13, which passes through both lugs as before and holds the ring clamped about the flanges of the meter case and its bowl 1.

The function of the winged element 15 is to receive and hold the barrel 23 of a bolt lock 25 with its axis at an angle to, and preferably substantially perpendicular to, the plane of the locking ring 7 and likewise to the front face of the meter. The bolt lock in turn holds a yoke 27 of hardened steel in place enclosing both lugs 9 and 11 and preventing access to the clamping screw 13 which holds the locking ring closed about the rims of bowl 1 and case 2.

Figure 3:
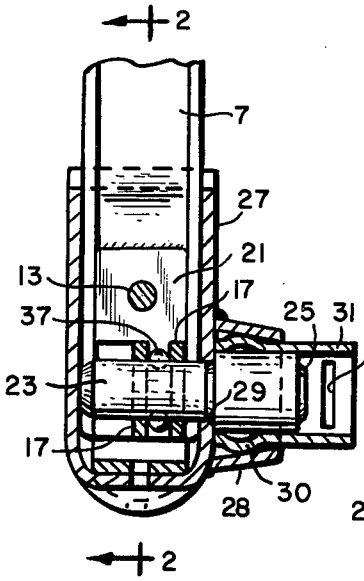
FIG. 3 is a vertical section on line 3—3 of FIG. 1.
Figure 4:
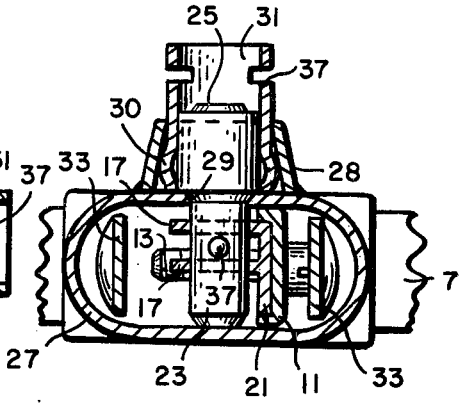
FIG. 4 is a horizontal section on line 4—4 of FIG. 2.

The yoke 27 has a tapered conical bushing 28 welded to one face concentric with a hole 29 receiving the barrel 23 of the lock and supporting a guide sleeve 31 swaged tightly and securely in fixed relation therein as shown at 30 in FIGS. 3 and 4 to receive the head portion 25 of the bolt lock. The tapered exterior of bushing 28 prevents it from being grasped tightly enough to be wrung off by a tool in the hands of a tamperer, while the sleeve 31 cooperates in shielding the head of the bolt lock from attack and provides a slot 37 for the ribbon of a pendent seal to serve as a moral deterrent and tell-tale against meddling, by blocking access to the keyhole in the axis of the head of the lock. The enlargement of the diameter of the inward portion of the sleeve incident to the swaging operation prevents its removal from the bushing.

Inside the yoke 27 is a U-shaped liner 33 of hardened steel spot-welded to the inside bottom of the yoke, to stiffen it and keep a prying tool away from the bend of the locking ring. Drain holes 35 are provided.

As is obvious, the barrel 23 of the bolt lock occupies the two aligned holes 19 in the wings 17 fixed on the long lug 11 of the locking ring, and the lock prevents the removal of the yoke to give access to the clamping screw 13, so long as the locking balls 37 are held extruded by the lock mechanism.

Since entry of the key into the bolt lock entirely from the front of the meter is thus made possible by this improved structure, with no need for leaving room between adjacent meters for the key and the hand, a marked gain in economy of wall space in mounting the meters and in time and convenience in servicing the meters is attained. It facilitates work on existing meter set-ups banked so closely as to make it awkward or difficult to use the former side-entry type of locking device.

While I have illustrated and described a certain form in which the invention may be embodied, I am aware that many modifications may be made therein by any person skilled in the art, without departing from the scope of the invention as expressed in the claims. Therefore, I do not wish to be limited to the particular form shown, or to the details of construction thereof, but What I do claim is:

1. Locking means for an electric meter having in combination a case holding the meter works, a cover, a U-section split locking ring uniting these two parts and having one of its ends provided with an aperture disposed in a plane at an angle to that of the locking ring, means on the ends of the locking ring to contract the ring, unbreakable means shielding such contracting means from access, and a bolt lock extending through the shielding means and the aperture with its axis at an angle to the plane of the ring and preventing removal of the shielding means.

2. The combination according to claim 1 in which a tapered bushing fixed on the shielding means with its axis at an angle to the plane of the locking ring receives the bolt lock.

3. The combination according to claim 2 in which a sleeve swaged into fixed relation in the bushing coaxially with the bushing receives the head of the bolt lock, and is slotted at points outwardly of the head.

4. The combination according to claim 3 in which a member having two parallel spaced wings with two aligned circular holes therein disposed parallel to the plane of the locking ring is provided on one lug to form an aperture for the bolt lock.

5. A locking ring for an electric meter comprising in combination a U-section split locking ring, means on its ends to contract the ring, unbreakable means shielding the contracting means from access, a bolt lock fixing the shielding means to the ring, a bushing on the shielding means maintaining the bolt lock at an angle to the plane of the ring, and a sleeve within the bushing receiving the head portion of the bolt lock.

* * * * *